US011506069B2

(12) United States Patent
White, III et al.

(10) Patent No.: US 11,506,069 B2
(45) Date of Patent: Nov. 22, 2022

(54) VANE ARC SEGMENT WITH SPRING SEAL

(71) Applicant: RAYTHEON TECHNOLOGIES CORPORATION, Farmington, CT (US)

(72) Inventors: Robert A. White, III, Meriden, CT (US); Benjamin B. Simpson, Talbott, TN (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/191,152

(22) Filed: Mar. 3, 2021

(65) Prior Publication Data

US 2022/0282630 A1 Sep. 8, 2022

(51) Int. Cl.
*F01D 9/04* (2006.01)

(52) U.S. Cl.
CPC ..... *F01D 9/042* (2013.01); *F05D 2220/32* (2013.01); *F05D 2240/12* (2013.01)

(58) Field of Classification Search
CPC ... F01D 9/02; F01D 9/04; F01D 9/041; F01D 9/042; F01D 5/28; F01D 5/282; F01D 5/284; F01D 11/005; F05D 2220/32; F05D 2240/12; F05D 2260/30; F05D 2260/38; F16J 15/00; F16J 15/02
See application file for complete search history.

(56) References Cited

U.S. PATENT DOCUMENTS 6,296,443 B1 10/2001 Newman et al.
10,208,614 B2 2/2019 Hafner et al.
10,428,663 B2 10/2019 Propheter-Hinckley
10,443,417 B2 10/2019 Fitzpatrick et al.
10,767,497 B2 9/2020 Vetters et al.
2008/0279679 A1 11/2008 Morrison
2013/0177400 A1* 7/2013 Ring ..... F01D 9/042 415/119
2016/0201487 A1* 7/2016 Spangler ..... F01D 5/189 415/115
2017/0101880 A1* 4/2017 Thomas ..... F01D 11/005
2017/0248027 A1* 8/2017 Schiavo ..... F01D 11/005
(Continued)

OTHER PUBLICATIONS

Partial European Search Report for European Patent Application No. 22160037.2 dated Aug. 5, 2022.

*Primary Examiner* — Eldon T Brockman
*Assistant Examiner* — Elton K Wong
(74) *Attorney, Agent, or Firm* — Carlson, Gaskey & Olds, P.C.

(57) ABSTRACT

A vane arc segment includes an airfoil fairing that has an airfoil wall that defines a fairing platform and a hollow airfoil section. A spar has a spar platform adjacent the fairing platform and a spar leg that extends from the spar platform and through the hollow airfoil section. The spar leg is spaced from the airfoil wall in the hollow airfoil section such that there is a first gap. The spar platform is spaced from the fairing platform such that there is a second gap. A support platform is secured to the spar leg such that the airfoil fairing is trapped between the spar platform and the support platform. There is a spring seal between the spar platform and the fairing platform. The spring seal biases the airfoil fairing toward the support platform and seals the first gap from the second gap.

20 Claims, 8 Drawing Sheets

(56) References Cited

U.S. PATENT DOCUMENTS

| | | | | |
|---|---|---|---|---|
| 2020/0080429 | A1 | 3/2020 | Vetters et al. | |
| 2020/0248569 | A1 | 8/2020 | Whittle et al. | |
| 2020/0408100 | A1 | 12/2020 | Whittle | |
| 2021/0207486 | A1* | 7/2021 | Sadler | F01D 25/28 |

* cited by examiner

VANE ARC SEGMENT WITH SPRING SEAL

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A vane arc segment according to an example of the present disclosure includes an airfoil fairing that has an airfoil wall defining a fairing platform and a hollow airfoil section extending there from. A spar has a spar platform adjacent the fairing platform and a spar leg that extends from the spar platform and through the hollow airfoil section. The spar leg is spaced from the airfoil wall in the hollow airfoil section such that there is a first gap there between, and the spar platform is spaced from the fairing platform such that there is a second gap there between. A support platform is secured to the spar leg such that the airfoil fairing is trapped between the spar platform and the support platform. A spring seal between the spar platform and the fairing platform biases the airfoil fairing toward the support platform and seals the first gap from the second gap.

In a further embodiment of any of the foregoing embodiments, the spring seal includes a seal plate defining an opening through which the spar leg extends.

In a further embodiment of any of the foregoing embodiments, the seal plate includes a base plate and a backing plate bonded to the base plate, the backing plate and the base plate defining a channel that circumscribes the opening.

In a further embodiment of any of the foregoing embodiments, the spring seal includes a rope seal disposed in the channel.

In a further embodiment of any of the foregoing embodiments, the base plate includes a plurality of through-holes that open into the channel.

In a further embodiment of any of the foregoing embodiments, the base plate defines a plurality of upstanding spring tabs.

In a further embodiment of any of the foregoing embodiments, each of the upstanding spring tabs includes a hooked tip that defines a bearing surface.

In a further embodiment of any of the foregoing embodiments, each of the upstanding spring tabs has an acute bend.

In a further embodiment of any of the foregoing embodiments, the upstanding spring tabs bear against the spar platform and the backing plate bears against the fairing platform.

In a further embodiment of any of the foregoing embodiments, the backing plate has a skirt portion that, relative to the opening, extends outwardly beyond the base plate.

In a further embodiment of any of the foregoing embodiments, the seal plate includes a projecting arm that overlaps an additional, adjacent seal.

In a further embodiment of any of the foregoing embodiments, the spring seal includes a seal plate defining an opening through which a baffle extends, and the seal plate is welded to the baffle around the opening.

A gas turbine engine according to an example of the present disclosure includes a compressor section, a combustor in fluid communication with the compressor section, and a turbine section in fluid communication with the combustor. The turbine section has vane arc segment disposed about a central axis of the gas turbine engine. Each of the vane arc segments includes an airfoil fairing that has an airfoil wall defining a fairing platform and a hollow airfoil section extending there from. A spar has a spar platform adjacent the fairing platform and a spar leg that extends from the spar platform and through the hollow airfoil section. The spar leg is spaced from the airfoil wall in the hollow airfoil section such that there is a first gap there between, and the spar platform is spaced from the fairing platform such that there is a second gap there between. A support platform is secured to the spar leg such that the airfoil fairing is trapped between the spar platform and the support platform. A spring seal between the spar platform and the fairing platform biases the airfoil fairing toward the support platform and seals the first gap from the second gap.

In a further embodiment of any of the foregoing embodiments, the spring seal includes a seal plate defining an opening through which the spar leg extends.

In a further embodiment of any of the foregoing embodiments, the seal plate includes a base plate and a backing plate bonded to the base plate, the backing plate and the base plate defining a channel that circumscribes the opening, and there is a rope seal disposed in the channel.

In a further embodiment of any of the foregoing embodiments, the base plate includes a plurality of through-holes that open into the channel.

In a further embodiment of any of the foregoing embodiments, the base plate defines a plurality of upstanding spring tabs. Each of the upstanding spring tabs has an acute bend and includes a hooked tip that defines a bearing surface. The upstanding spring tabs bear against the spar platform, and the backing plate bears against the fairing platform.

In a further embodiment of any of the foregoing embodiments, the backing plate has a skirt portion that, relative to the opening, extends outwardly beyond the base plate.

A spring seal for a vane arc segment according to an example of the present disclosure includes a seal plate defining an opening. The seal plate includes a base plate and a backing plate bonded to the base plate. The backing plate and the base plate define a channel that circumscribes the opening. The base plate has a plurality of upstanding spring tabs, and there is a rope seal disposed in the channel.

In a further embodiment of any of the foregoing embodiments, the base plate defines a plurality of upstanding spring tabs. Each of the upstanding spring tabs has an acute bend and includes a hooked tip that defines a bearing surface. The base plate includes a plurality of through-holes that open into the channel, and the backing plate has a skirt portion that, relative to the opening, extends outwardly beyond the base plate.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
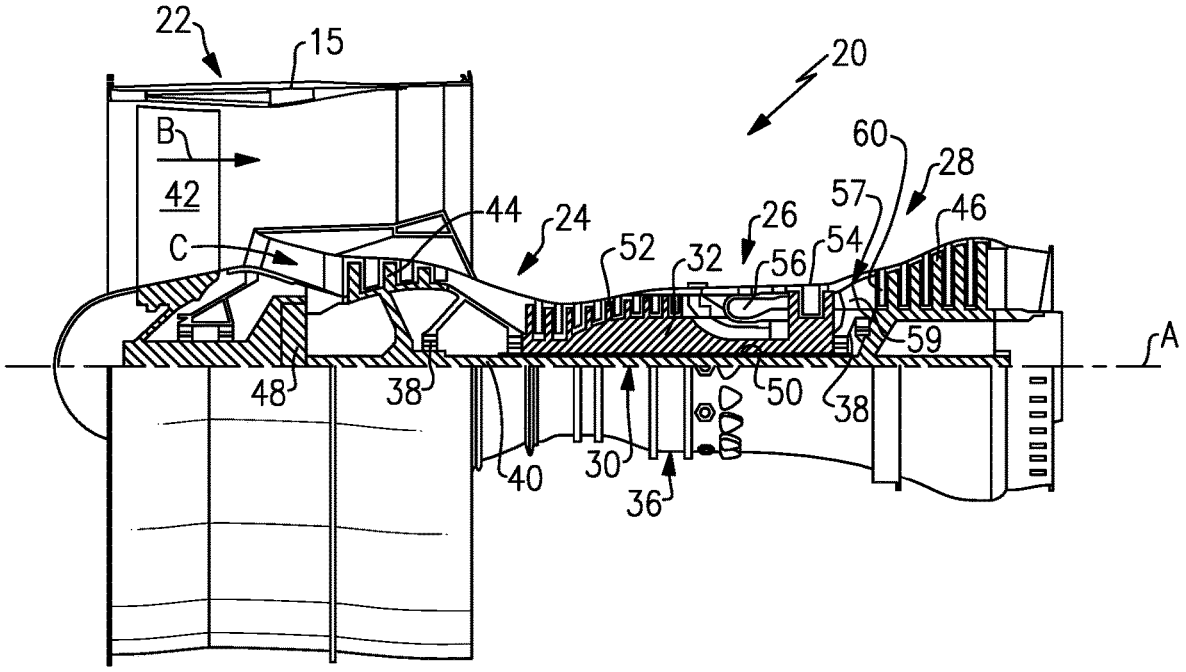
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
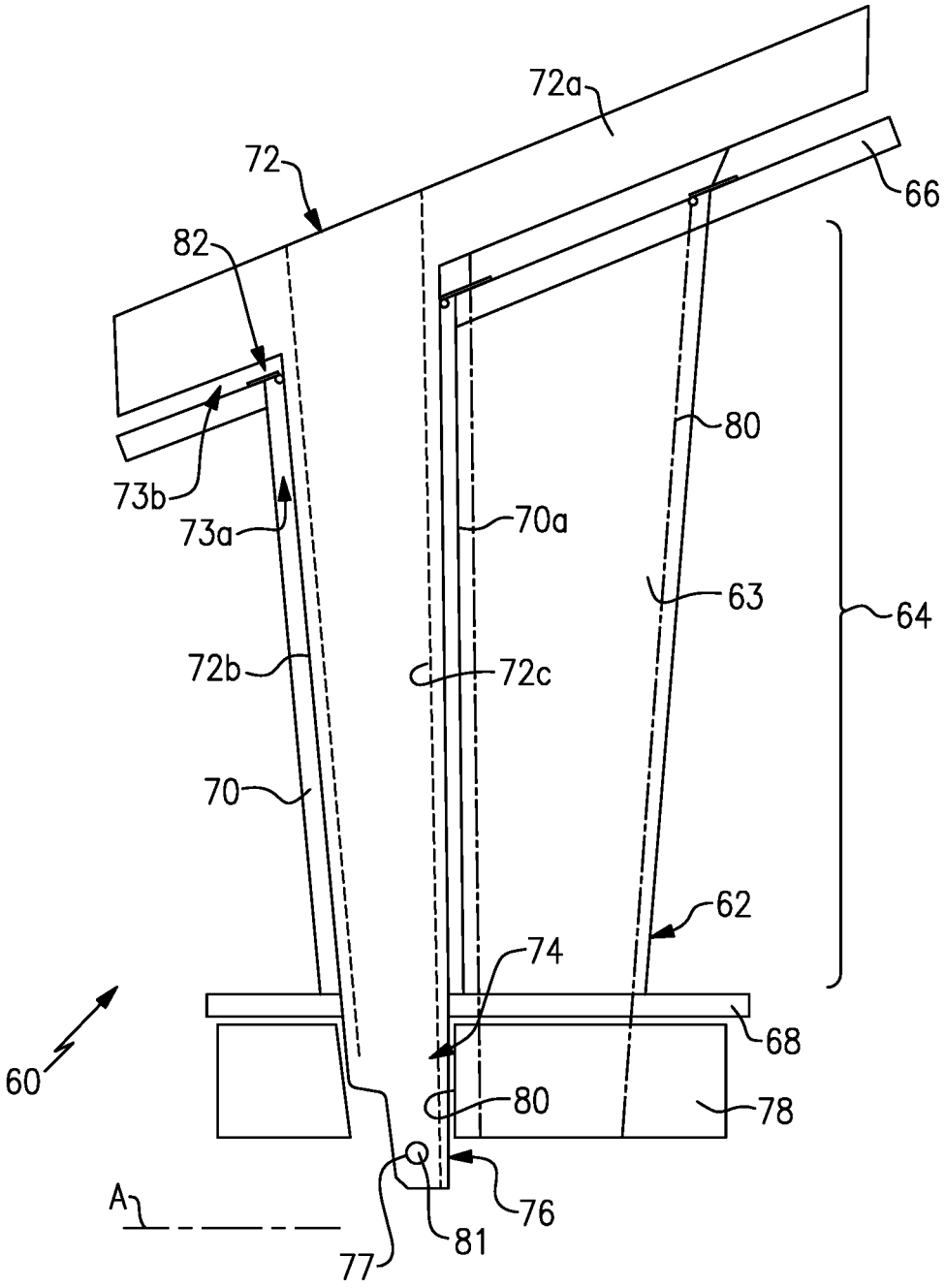
FIG. 2 illustrates a vane arc segment of the engine.

FIG. 2 illustrates a line representation of an example of a vane arc segment 60 from the turbine section 28 of the engine 20 (see also FIG. 1). It is to be understood that although the examples herein are discussed in context of a vane from the turbine section, the examples can be applied to other vanes that have support spars.

The vane arc segment 60 includes an airfoil fairing 62 that is formed by an airfoil wall 63. The airfoil fairing 62 is comprised of an airfoil section 64 and first and second platforms 66/68 between which the airfoil section 64 extends. The airfoil section 64 generally extends in a radial direction relative to the central engine axis A. Terms such as "inner" and "outer" used herein refer to location with respect to the central engine axis A, i.e., radially inner or radially outer. Moreover, the terminology "first" and "second" used herein is to differentiate that there are two architecturally distinct components or features. It is to be further understood that the terms "first" and "second" are interchangeable in that a first component or feature could alternatively be termed as the second component or feature, and vice versa.

The airfoil wall 63 is continuous in that the platforms 66/68 and airfoil section 64 constitute a unitary body. As an example, the airfoil wall 63 is formed of a ceramic matrix composite, an organic matrix composite (OMC), or a metal matrix composite (MMC). For instance, the ceramic matrix composite (CMC) is formed of ceramic fiber tows that are disposed in a ceramic matrix. The ceramic matrix composite may be, but is not limited to, a SiC/SiC ceramic matrix composite in which SiC fiber tows are disposed within a SiC matrix. Example organic matrix composites include, but are not limited to, glass fiber tows, carbon fiber tows, and/or aramid fiber tows disposed in a polymer matrix, such as epoxy. Example metal matrix composites include, but are not limited to, boron carbide fiber tows and/or alumina fiber tows disposed in a metal matrix, such as aluminum. A fiber tow is a bundle of filaments. As an example, a single tow may have several thousand filaments. The tows may be arranged in a fiber architecture, which refers to an ordered arrangement of the tows relative to one another, such as, but not limited to, a 2D woven ply or a 3D structure.

The airfoil section 64 circumscribes an interior through-cavity 70. The airfoil section 64 may have a single through-cavity 70 or, as in the illustrated example, the cavity 70 may be divided by one or more ribs 70*a* into a forward sub-cavity and an aft sub-cavity. The vane arc segment 60 further includes a spar 72 that extends through the through-cavity 70 and mechanically supports the airfoil fairing 62. The spar 72 may be formed of a relatively high temperature resistance, high strength material, such as a single crystal metal alloy (e.g., a single crystal nickel- or cobalt-alloy).

The spar 72 includes a spar platform 72*a* and a spar leg 72*b* that extends from the spar platform 72*a* into the through-cavity 70 (i.e., the forward sub-cavity in this example). The spar leg 72*b* is spaced from the airfoil wall 63 such that there is a first gap 73*a* between the airfoil wall 63 and the spar leg 72*b*. Cooling air may be provided into the first gap 73*a* to cool the airfoil wall 63. The spar platform 72*a* is spaced from the fairing platform 66 such that there is a second gap 73*b* there between. Although not shown, the spar platform 72*a* includes attachment features that secure it to a fixed support structure, such as an engine case. The spar leg 72*b* defines an interior through-passage 72*c*.

The spar leg 72*b* has a distal end portion 74 that has a clevis mount 76. The end portion 74 of the spar leg 72*b* extends past the platform 68 of the airfoil fairing 62 so as to protrude from the fairing 62. There is a support platform 78 adjacent the platform 68 of the airfoil fairing. Although not shown, the support platform 78, the platform 68 of the airfoil fairing 62, or both may have flanges or other mounting features through which the support platform 78 interfaces with the platform 68.

The support platform 78 includes a through-hole 80 through which the end portion 74 of the spar leg 72*b* extends such that at least a portion of the clevis mount 76 protrudes from the support platform 78. The clevis mount 76 is comprised of two spaced-apart prongs that have aligned holes 77 through which a pin 81 extends. The pin 81 is wider than the through-hole 80 of the support platform 78. The ends of the pin 81 thus abut the face of the support platform 78 and thereby prevent the spar leg 72*b* from being retracted in the through-hole 80. The pin 81 thus locks the support platform 78 to the spar leg 72*b* such that the airfoil fairing 62 is mechanically trapped between the spar platform 72*a* and the support platform 78. It is to be appreciated that the example configuration could be used at the outer end of the airfoil fairing 62, with the spar 72 being inverted such that the spar platform 72*a* is adjacent the platform 68 and the support platform 78 is adjacent the fairing platform 66. Moreover, although the illustrated example utilizes the clevis mount 76 to secure the spar leg 72*b* and support platform 78 together, other locking mechanisms may alternatively be used.

In this example, the vane arc segment 60 also includes a baffle 80 that extends through the through-cavity 70 (i.e., the aft sub-cavity). The baffle 80 may have impingement holes for distributing cooling air onto the airfoil wall 63. If the through-cavity 70 does not contain any ribs and is only a single cavity, the baffle 80 is excluded, and if the through-cavity 70 contains multiple ribs 70*a*, additional baffles may be used.

Cooling air, such as bleed air from the compressor section 24, is conveyed into and through the through-passage 72*c* of the spar 72. This cooling air is destined for a downstream cooling location, such as a tangential onboard injector (TOBI). Cooling air may also be provided into the baffle 80 and the first gap 73*a* gap between the airfoil wall 63 and the spar leg 72*b*. The through-passage 72*c* of the spar leg 72*b* is fully or substantially fully isolated from the first gap 73*a*. Thus, the cooling air in the through-passage 72*c* does not intermix with cooling air in the first gap 73*a*. The cooling air provided to the first gap 73*a* and to the baffle 80 is fluidly isolated from the second gap 73*b* between the spar platform 72*a* and the fairing platform 66. In this regard, the vane arc segment 60 includes a spring seal 82.

The spring seal 82 serves dual functions in the vane arc segment 60. As indicated, the spring seal 82 first serves as a seal to isolate the first gap 73*a* from the second gap 73*b* and to isolate the aft sub-cavity of the through-cavity 70 from the second gap 73*b*. The spring seal 82 also serves to bias the airfoil fairing 62 toward the support platform 78. The biasing facilitates attenuation of radial tolerances in the assembly in that dimensional variations in the components is taken up by compression of the spring seal 82. Moreover, the biasing also facilitates proper positioning of the components during assembly, idle, and engine shut-down by urging the airfoil fairing 62 toward the support platform 78. Also, if additional seals are used, the biasing may also serve to constrain and position those seals. The spring seal 82 in the illustrated example is provided at the outer diameter of the airfoil fairing 62. It is to be understood, however, that the example configuration may be inverted such that the spring seal 82 is at the inner diameter. Moreover, it is also contemplated that spring seals 82 be provided at both the inner and outer diameter locations.

Figure 3A:
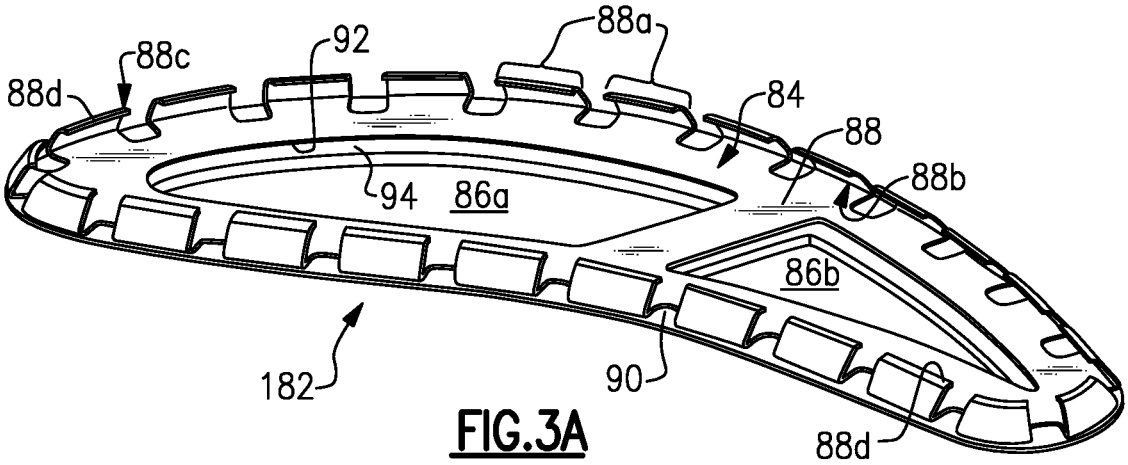
FIG. 3A illustrates a spring seal.
Figure 3B:
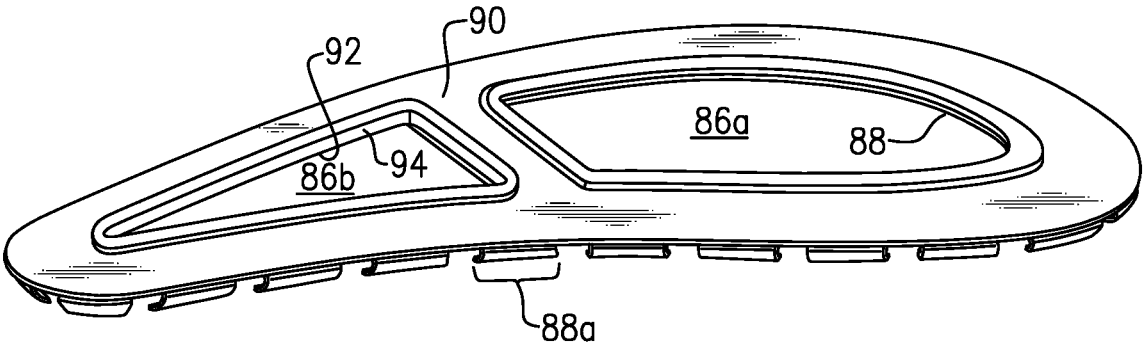
FIG. 3B illustrates another view of the spring seal of FIG. 3A.

FIG. 3A illustrates an isometric view of an example spring seal 182 that may be used in the vane arc segment 60, and FIG. 3B illustrates the spring seal 182 from the bottom. In this disclosure, like reference numerals designate like elements where appropriate and reference numerals with the addition of one-hundred or multiples thereof designate modified elements that are understood to incorporate the same features and benefits of the corresponding elements. The spring seal 182 generally includes a seal plate 84 that defines an opening 86*a* through which the spar leg 72*b* extends. In this example, since the through-cavity 70 is divided into sub-cavities, the spring seal 182 is also configured with an additional opening 86*b* through which the baffle 80 extends. Alternatively, if the through-cavity 70 had no rib, the spring seal 82 would have only a single opening.

The seal plate 84 includes a base plate 88 and a backing plate 90 that is bonded to the base plate 88. For example, the plates 88/90 are metallic and are welded together, although brazing or other metallurgical attachment may alternatively be used. The plates 88/90 define a channel 92 that circumscribes the openings 86*a*/86*b*. There is a rope seal 94 disposed in the channel. The rope seal 94 is an endless ring, but may alternatively be a split ring in order to accommodate tight curvatures, for example. The base plate 88 defines a plurality of upstanding spring tabs 88*a*. The spring tabs 88*a* are spaced around the periphery of the base plate 88 so as to form a row that circumscribes the openings 86*a*/86*b*. As shown, the spring tabs 88*a* turn back so as to define an acute bend 88*b*, but obtuse bends may alternatively be utilized. The spring tabs 88*a* deflect at the bend 88*b* to provide the biasing discussed above. In this example, the spring tabs 88*a* also have hooked tips 88*c* that define bearing surfaces 88*d*.

Figure 4A:
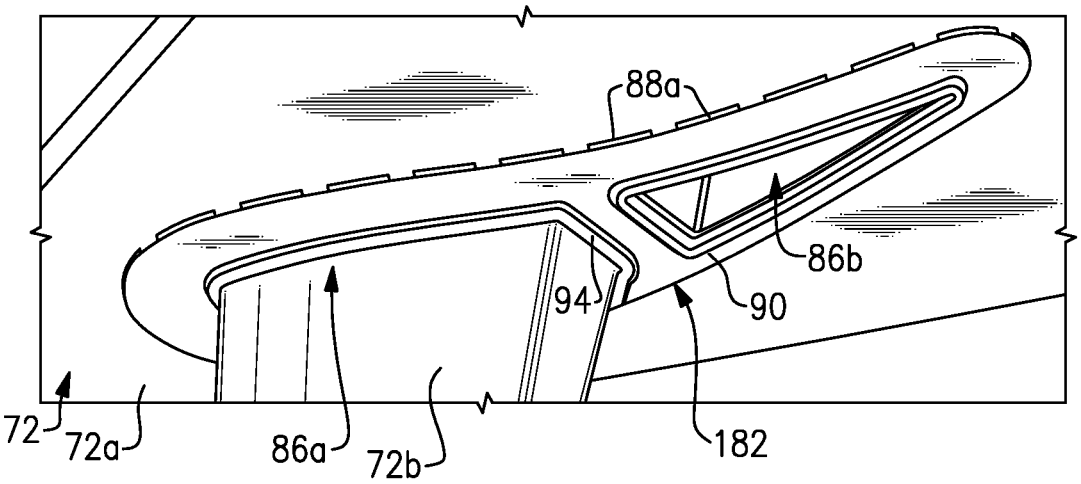
FIG. 4A illustrates a spring seal on a leg of a spar.
Figure 4B:
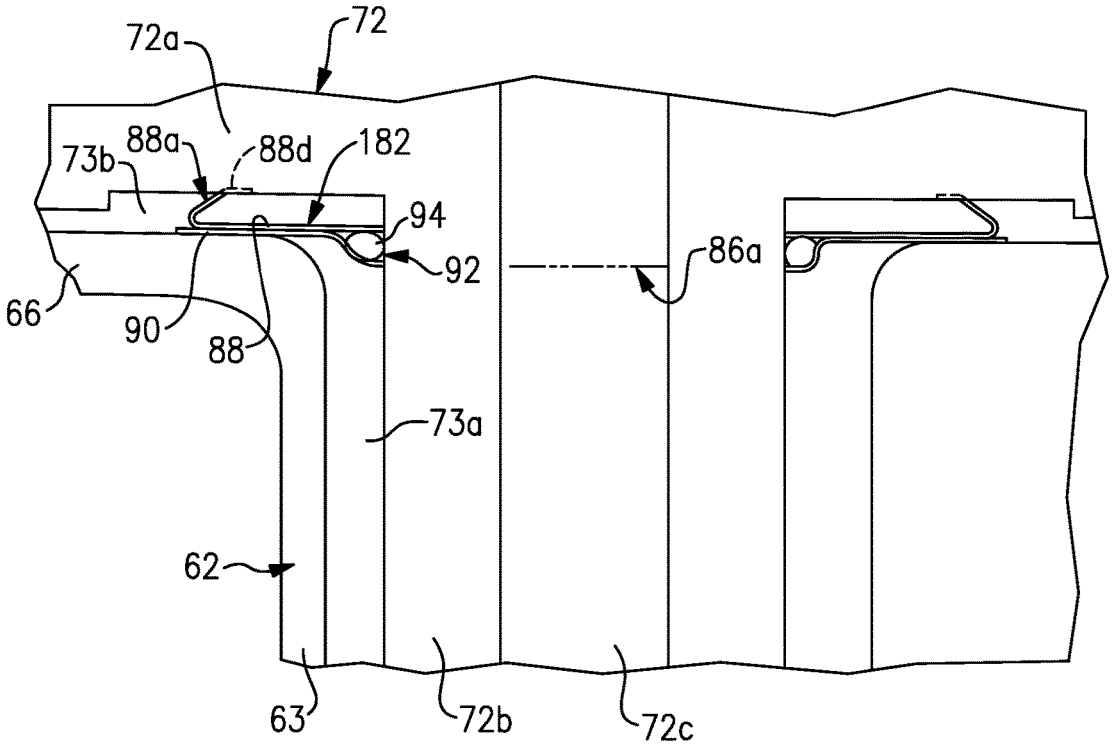
FIG. 4B illustrates a spring seal in a vane arc segment.

As shown in FIGS. 4A and 4B, the spar leg 72*b* is received through the opening 86*a* of the spring seal 182. The spring tabs 88*a* contact the spar platform 72*a* such that the bearing surfaces 88*d* bear against the surface of the spar platform 72*a*. The backing plate 90 bears against the fairing platform 66 and thus provides a seal therewith. In these regards, the base plate 88 and the backing plate 90 may be of the same or different thicknesses in order to tailor the performance. For instance, the thickness of the base plate 88 is used to tailor the spring constant of the spring tabs 88*a*, and the thickness of the backing plate 90 is used to tailor the ability of the backing plate 90 to deflect and conform against the fairing platform 66 for sealing.

Figure 5:
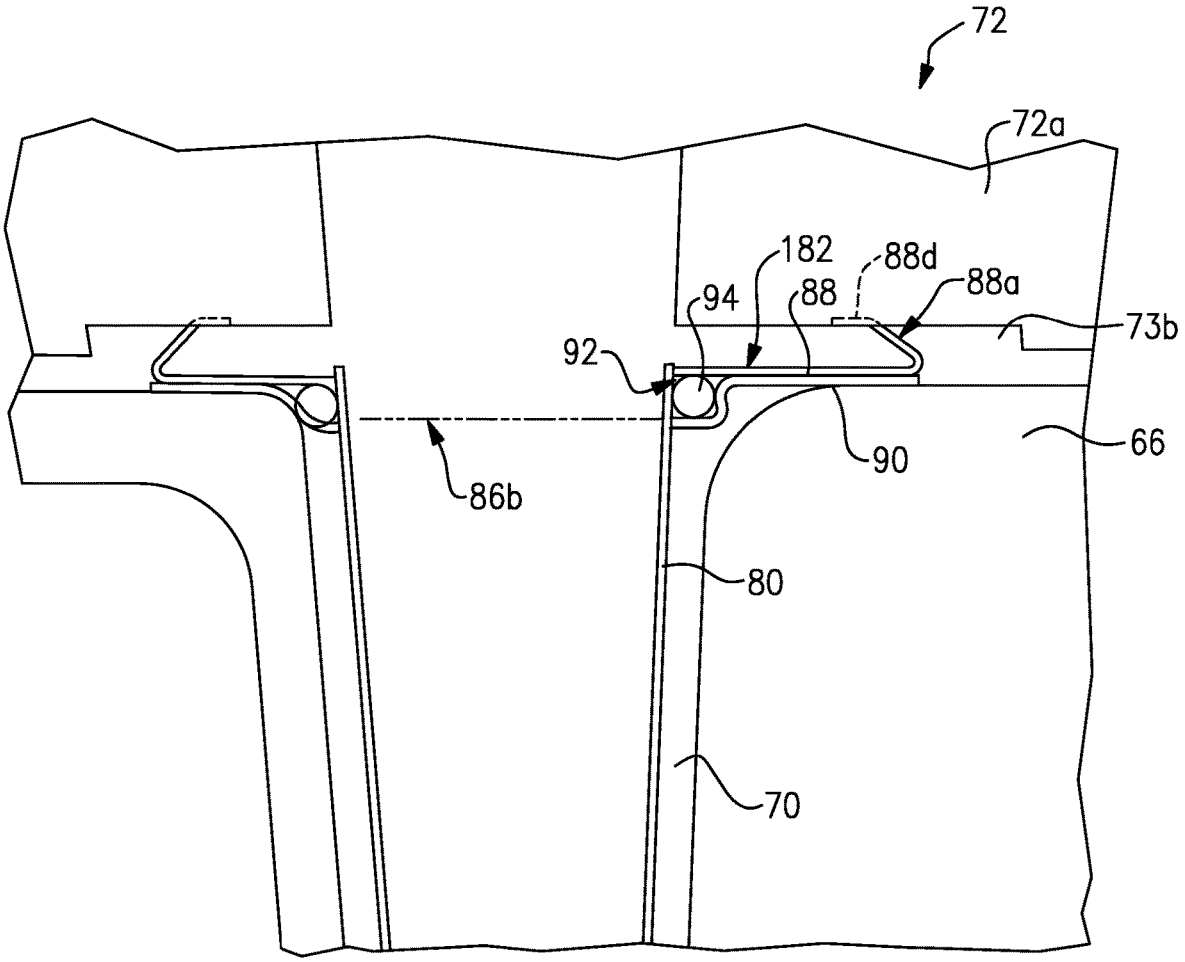
FIG. 5 illustrates a spring seal sealing with a baffle.

The rope seal 94 seals against the spar leg 72*b* in this example. The sealing of the rope seal 94 against the spar leg 72*b* and the sealing of the backing plate 90 against the fairing platform 66 isolates the first gap 73*a* from the second gap 73*b*. Moreover, the spring seal 182 is clamped between the fairing platform 66 and the spar platform 72*a*, thereby compressing the spring tabs 88*a* to provide the aforementioned biasing. Likewise, as shown in FIG. 5, the baffle 80 is received through the opening 86*b* of the spring seal 182 such that the rope seal 94 seals against the baffle 80.

Figure 6:
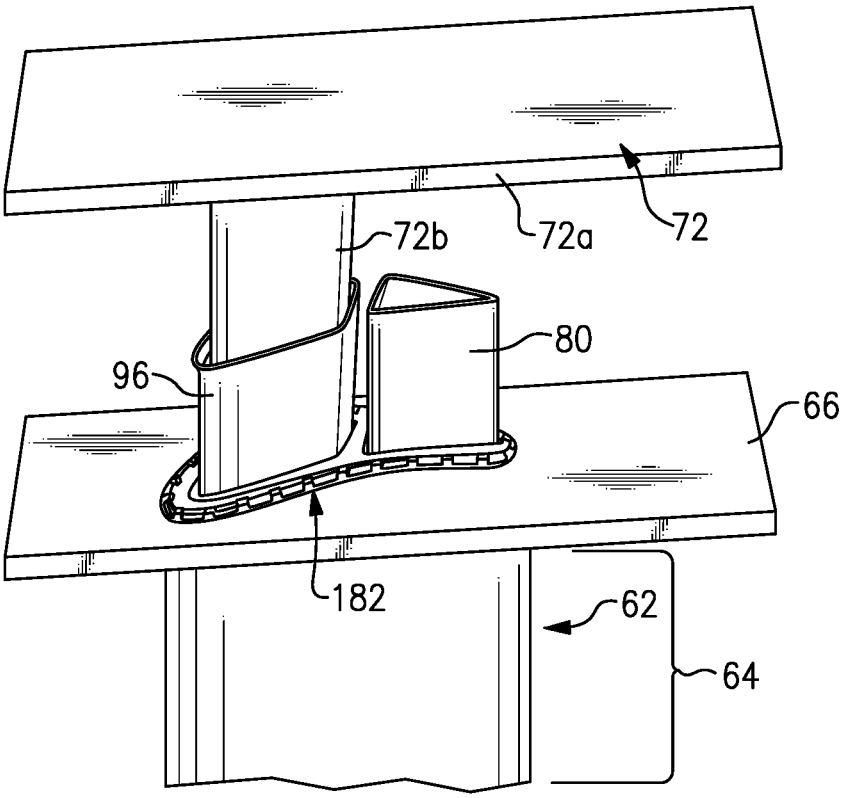
FIG. 6 illustrates a spring seal sealing against a baffle on a spar leg of a spar.

FIG. 6 illustrates another example in which there is a baffle 96 around the spar leg 72*b*. The baffle 96 is disposed in the first gap 73*a* in the airfoil section 64. Here, rather than the spring seal 182 sealing against the spar leg 72*b*, the spring seal 182 seals against the baffle 96.

Figure 7:
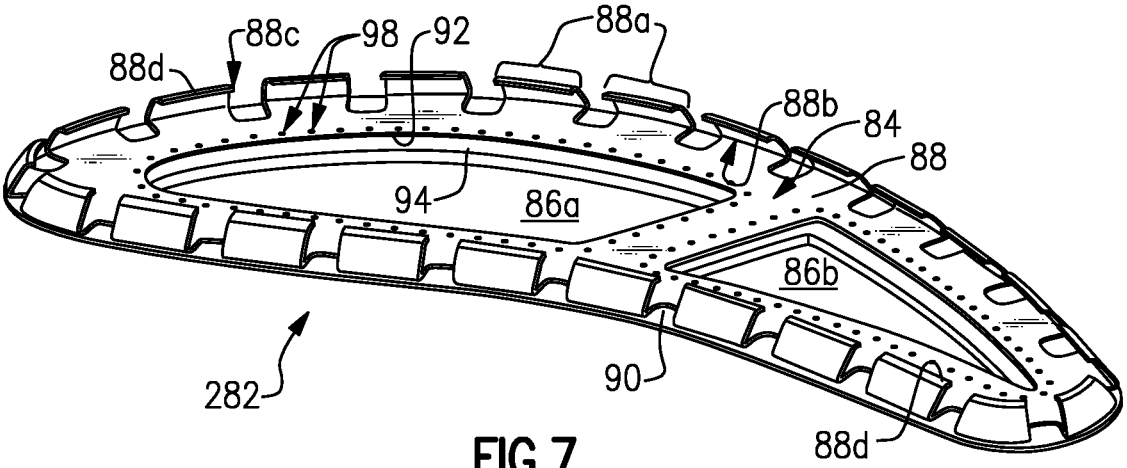
FIG. 7 illustrates another example spring seal that has through-holes for pressurizing the rope seal.
Figure 8:
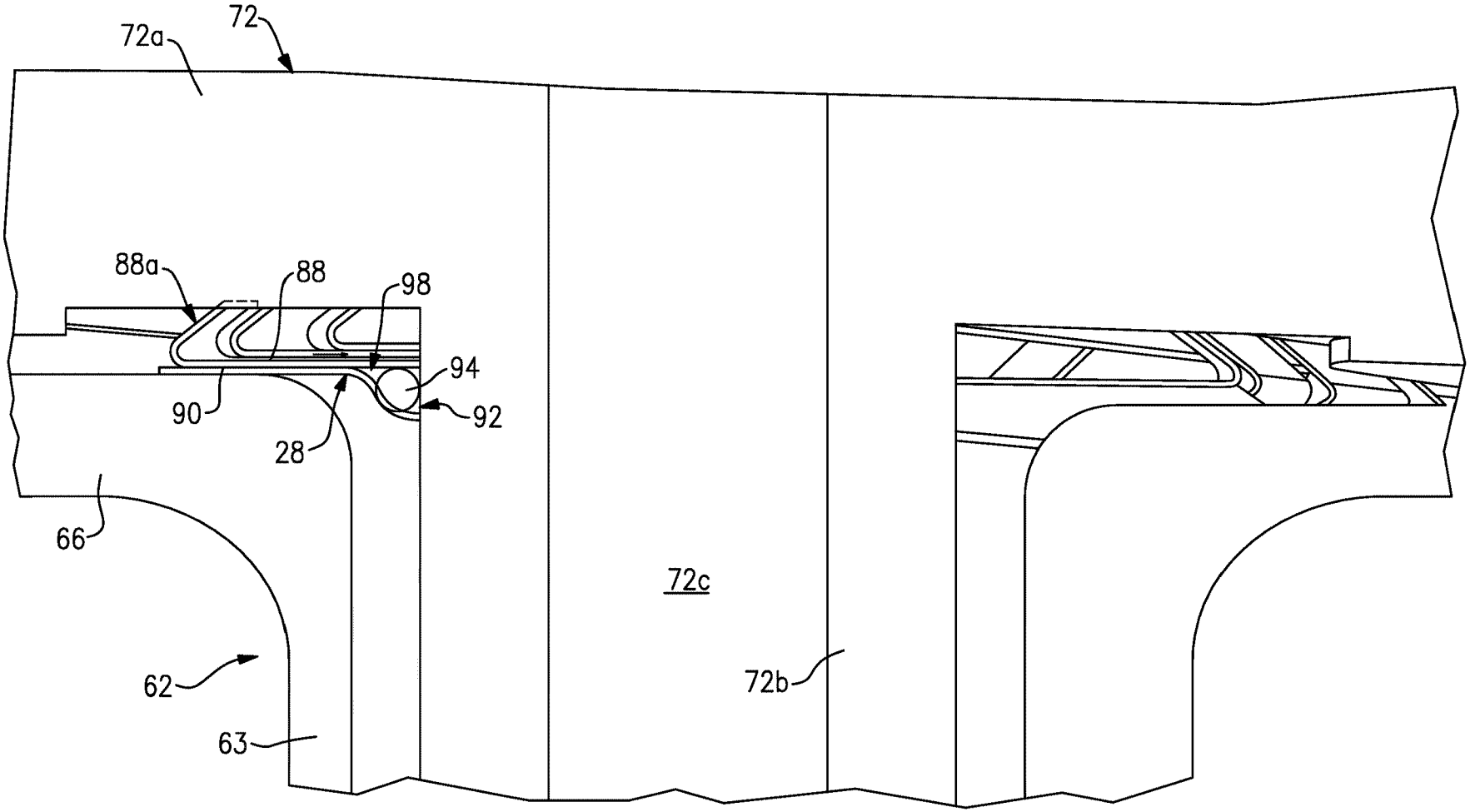
FIG. 8 illustrates the spring seal of FIG. 7 in a vane arc segment.

FIG. 7 illustrates another example spring seal 282 that is similar to the spring seal 182 except that the base plate 88 includes a plurality of through-holes 98 that open into the channel 92 behind the rope seal 94. As shown in FIG. 8, cooling air provided to the base plate 88 on the side of the spar platform 72*a* flows though the through-holes 98. The cooling air is pressurized (e.g., bleed air from the compressor section 24) and biases the rope seal 94 against the spar leg 72*b* to facilitate good sealing between the rope seal 94 and the spar leg 72*b*.

Figure 9:
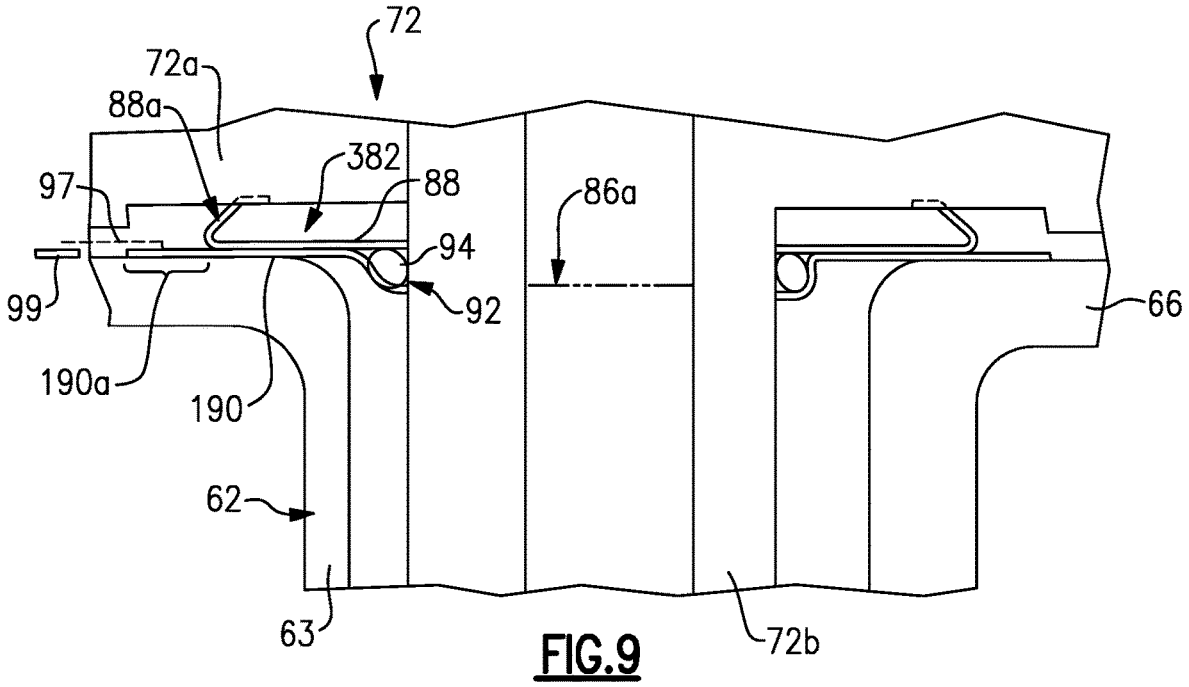
FIG. 9 illustrates another example in which the spring seal has a skirt portion.

FIG. 9 illustrates another example spring seal 382. The spring seal 383 is similar to the spring seal 182 except that the backing plate 190 in this example is larger than the backing plate 90 in the prior example such that the backing plate 190 has a skirt portion 190*a*. Relative to the opening 86*a*, the skirt portion 190*a* extends outwardly beyond the base plate 88. The skirt portion 190*a* provides additional surface area for sealing with the fairing platform 66. Moreover, since the skirt portion 190*a* is, in essence, cantilevered from the base plate 88, there is less of a stiffening effect from the base plate 88 and the skirt portion 190*a* can thus be more compliant to seal against the fairing platform 66. Optionally, as also depicted in FIG. 9, the backing plate 190 (and/or the base plate 88) may include one or more projecting arms 97. The arm or arms 97 extend outwardly and overlap with an adjacent seal 99. The biasing force from the spring tabs 88*a* is transmitted though the arm 97 to exert a biasing force on the seal 99, thereby facilitating maintaining the seal 99 in place.

In further examples of any of the examples above, the rope seal 94 (and optionally the channel 92) is excluded. The sealing function is instead served by welding the edges of the base plate 88 and/or the backing plate 90 around the openings 86*a*/86*b* to the respective baffles 80/96.

Figure 10:
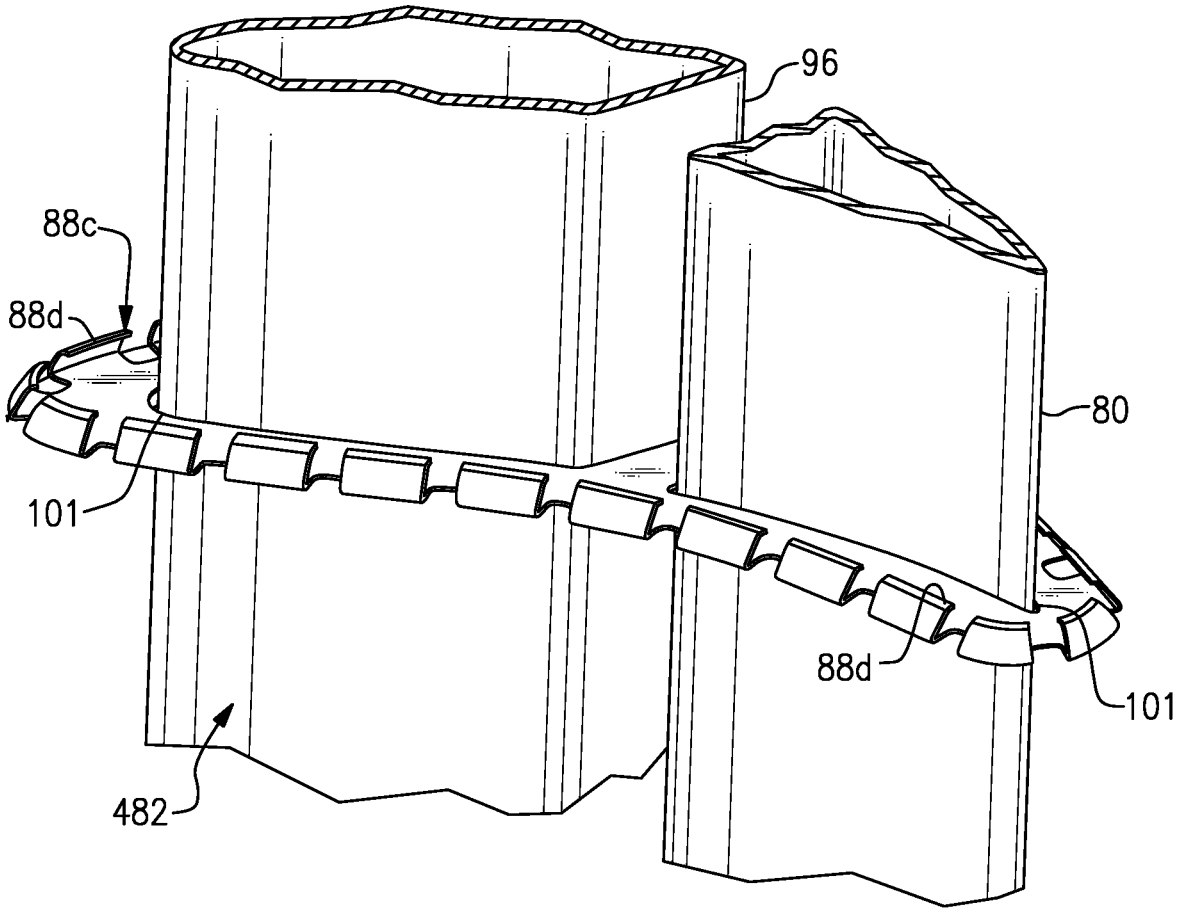
FIG. 10 illustrates an example of a spring seal without a backing plate and rope seal.

FIG. 10 illustrates another example spring seal 482. In this example, the spring seal 482 does not have the backing plate 90 as in prior examples and instead only has the base plate 88. As a result, the channel 92 and rope seal 94 are eliminated. As above, the sealing function is instead served by welding the edges of the base plate 88 around the openings 86*a*/86*b* at weld joints 101 to the respective baffles 80/96.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A vane arc segment comprising:

an airfoil fairing having an airfoil wall defining a fairing platform and a hollow airfoil section extending there from;

a spar having a spar platform adjacent the fairing platform and a spar leg that extends from the spar platform and through the hollow airfoil section, the spar leg being spaced from the airfoil wall in the hollow airfoil section such that there is a first gap there between, and the spar platform being spaced from the fairing platform such that there is a second gap there between;

a support platform secured to the spar leg such that the airfoil fairing is trapped between the spar platform and the support platform; and a spring seal between the spar platform and the fairing platform, the spring seal biasing the airfoil fairing toward the support platform and sealing the first gap from the second gap, the spring seal including a seal plate, a base plate, and a backing plate, the seal plate defining an opening through which the spar leg extends, the backing plate bonded to the base plate, and the backing plate and the base plate defining a channel that circumscribes the opening.

2. The vane arc segment as recited in claim 1, wherein the spring seal includes a rope seal disposed in the channel.

3. The vane arc segment as recited in claim 2, wherein the base plate includes a plurality of through-holes that open into the channel.

4. The vane arc segment as recited in claim 3, wherein the base plate defines a plurality of upstanding spring tabs.

5. The vane arc segment as recited in claim 4, wherein each of the upstanding spring tabs includes a hooked tip that defines a bearing surface.

6. The vane arc segment as recited in claim 4, wherein each of the upstanding spring tabs has an acute bend.

7. The vane arc segment as recited in claim 4, wherein the upstanding spring tabs bear against the spar platform and the backing plate bears against the fairing platform.

8. The vane arc segment as recited in claim 4, wherein the backing plate has a skirt portion that, relative to the opening, extends outwardly beyond the base plate.

9. The vane arc segment as recited in claim 1, wherein the seal plate includes a projecting arm that overlaps an additional, adjacent seal.

10. The vane arc segment as recited in claim 1, wherein a baffle extends through the opening of the seal plate, and the seal plate is welded to the baffle around the opening.

11. The vane arc segment as recited in claim 1, wherein the spring seal circumscribes the spar leg, and the spring seal seals against either the spar leg or a baffle that circumscribes the spar leg.

12. A gas turbine engine comprising:

a compressor section;

a combustor in fluid communication with the compressor section; and a turbine section in fluid communication with the combustor, the turbine section having vane arc segments disposed about a central axis of the gas turbine engine, each of the vane arc segments includes:

an airfoil fairing having an airfoil wall defining a fairing platform and a hollow airfoil section extending there from, a spar having a spar platform adjacent the fairing platform and a spar leg that extends from the spar platform and through the hollow airfoil section, the spar leg being spaced from the airfoil wall in the hollow airfoil section such that there is a first gap there between, and the spar platform being spaced from the fairing platform such that there is a second gap there between, a support platform secured to the spar leg such that the airfoil fairing is trapped between the spar platform and the support platform, and a spring seal between the spar platform and the fairing platform, the spring seal biasing the airfoil fairing toward the support platform and sealing the first gap from the second gap.

13. The gas turbine engine as recited in claim 12, wherein the spring seal includes a seal plate defining an opening through which the spar leg extends.

14. The gas turbine engine as recited in claim 13, wherein the seal plate includes a base plate and a backing plate bonded to the base plate, the backing plate and the base plate defining a channel that circumscribes the opening, and a rope seal disposed in the channel.

15. The gas turbine engine as recited in claim 14, wherein the base plate includes a plurality of through-holes that open into the channel.

16. The gas turbine engine as recited in claim 14, wherein the base plate defines a plurality of upstanding spring tabs, each of the upstanding spring tabs has an acute bend and includes a hooked tip that defines a bearing surface, the upstanding spring tabs bear against the spar platform, and the backing plate bears against the fairing platform.

17. The gas turbine engine as recited in claim 14, wherein the backing plate has a skirt portion that, relative to the opening, extends outwardly beyond the base plate.

18. The gas turbine engine as recited in claim 12, wherein the spring seal circumscribes the spar leg, and the spring seal seals against either the spar leg or a baffle that circumscribes the spar leg.

19. A spring seal for a vane arc segment, the spring seal comprising:

a seal plate defining an opening, the seal plate including a base plate and a backing plate bonded to the base plate, the backing plate and the base plate defining a channel that circumscribes the opening, the base plate having a plurality of upstanding spring tabs; and a rope seal disposed in the channel.

20. The spring seal as recited in claim 19, wherein each of the upstanding spring tabs has an acute bend and includes a hooked tip that defines a bearing surface, the base plate includes a plurality of through-holes that open into the channel, and the backing plate has a skirt portion that, relative to the opening, extends outwardly beyond the base plate.

* * * * *